United States Patent [19]

Nishida et al.

[11] 4,416,226

[45] Nov. 22, 1983

[54] LASER IGNITION APPARATUS FOR AN INTERNAL COMBUSTION ENGINE

[75] Inventors: Minoru Nishida; Tadashi Hattori; Shinichi Mukainakano, all of Okazaki; Toru Mizuno, Aichi; Tukasa Goto, Kariya, all of Japan

[73] Assignees: Nippon Soken, Inc., Nishio; Nippondenso Co., Ltd., Kariya, both of Japan

[21] Appl. No.: 383,835

[22] Filed: Jun. 1, 1982

[30] Foreign Application Priority Data

Jun. 2, 1981 [JP] Japan ..... 56-85308

[51] Int. Cl.[3] ..... F02P 23/00

[52] U.S. Cl. ..... 123/143 B; 123/143 R

[58] Field of Search ..... 123/143 B, 143 R, 637, 123/638

[56] References Cited

U.S. PATENT DOCUMENTS

| | | | |
|---|---|---|---|
| 3,280,809 | 10/1966 | Issler | 123/637 |
| 3,861,371 | 1/1975 | Gamell | 123/143 B |
| 4,122,816 | 10/1978 | Fitzgerald | 123/143 B |
| 4,314,530 | 2/1982 | Giacchehi | 123/143 B |

FOREIGN PATENT DOCUMENTS

| | | | |
|---|---|---|---|
| 964539 | 3/1975 | Canada | 123/143 B |
| 2207392 | 8/1973 | Fed. Rep. of Germany | 123/143 B |
| 2924910 | 1/1981 | Fed. Rep. of Germany | 123/143 B |

*Primary Examiner*—Ronald B. Cox

*Attorney, Agent, or Firm*—Cushman, Darby & Cushman

[57] ABSTRACT

A laser ignition apparatus includes a laser oscillator which generates at least two successive pulse-shaped laser beams during each compression stroke of the engine. A first pulse-shaped laser beam is generated by a Q switching action of the laser oscillator and thus has a high peak output and a second pulse-shaped laser beam is generated without the Q switching action and has a low peak output but a larger pulse duration than the first laser beam. The first and second pulse-shaped laser beams are guided and directed into the combustion chamber of the engine and the first laser beam of a high energy density causes the breakdown of the air-fuel mixture in the combustion chamber to develop a plasma and the second laser beam further increases the energy of the plasma thereby to ensure the setting fire of the air-fuel mixture.

5 Claims, 15 Drawing Figures

LASER IGNITION APPARATUS FOR AN INTERNAL COMBUSTION ENGINE

BACKGROUND OF THE INVENTION

1. Field of the Invention

This invention relates to an ignition apparatus for an internal combustion engine, and more particularly to a laser ignition apparatus for an internal combustion engine which causes ignition of the air-fuel mixture by a laser beam with a high energy density.

2. Description of the Prior Art

In a usual ignition apparatus for an internal combustion engine, a high voltage is applied to an ignition plug which is fixed on the wall surface of a combustion chamber in order to ignite the air-fuel mixture by spark discharge. In an ignition apparatus of this kind, since the ignition plug is exposed directly to the combustion chamber, carbon generated attaches to an insulator of the ignition plug to render the discharge of the ignition plug difficult. Furthermore, due to a heat loss of the electrodes of the ignition plug, a torch or nucleus of flame generated by the discharge is cooled, and vanished before reaching a flame. Since the ignition occurs on the wall surface of the combustion chamger, the condition of the air-fuel mixture is difficult to be ignited than at the center part of the chamger. Even if it is ignited, it takes a considerable time before the flame spreads over the whole space of the combustion chamber. In order to circumvent these defects, an ignition plug has been proposed, in which the electrodes are made to protrude into the center part of the combustion chamber. However, there have been still problems of durability of electrodes and of preignition in which the combustion precedes the ignition timing.

In order to overcome these problems, a laser ignition apparatus using a light beam with a high energy density such as laser has been proposed, in which the light beam is focussed on a predetermined position in the combustion chamber for ignition. In this method, the laser beam is directly irradiated on the air-fuel mixture and raises the temperature of the gas molecules thereby to cause ignition. However, since the rate of light absorpotion of the air-fuel mixture is small, a practical difficulty arises in ignition. Therefore, another method has been proposed, in which a laser beam causes, at first, breakdown of gas and then the produced plasma ignites the ambient air-fuel mixture. In order that the gas breakdown by the laser beam is ensured, the energy density should be above $10^9$ to $10^{10}$ W/cm$^2$ at a normal pressure under which the ignition occures. Although the energy density can be increased by decreasing the size of the focal point of the laser beam, there is a limit on the efficiency. For example, if the diameter of focal point is 50 $\mu$m, an output of the order of $8\times10^4$ to $8\times10^5$ W is necessary from an atmospheric pressure to 10 atm. Such a large output can not be realized by a CW laser. A pulsed laser is therefore used and the output is enhanced by Q switching. In this case, the pulse width of the laser is usually very short, say less than $10^{-7}$ sec (100 nsec). The high temperature plasma produced by the Q switching pulsed laser diffuses rapidly with time. From a viewpoint of ignition phenomenon, a period of 100 $\mu$sec to 1 msec is usually needed before the flame nucleus is formed and grows flames. It is necessary that the energy is supplied intermittently or continuously to the flame nucleus. In order to ignite the air-fuel mixture by a single short pulse of the laser, the energy should be larger than the value required for the gas breakdown. This is not preferrable in view of the energy efficiency.

SUMMARY OF THE INVENTION

The object of the present invention is to provide a laser ignition apparatus capable of igniting the air-fuel mixture by irradiating at least two or more than two pulse-shaped laser beams.

According to this invention, a first pulse of laser beam with an energy density capable of gas breakdown is focussed into a combustion chamber to cause the breakdown. Next, at least one or more of second and third, . . . pulses of laser beam are irradiated to the plasma produced by the breakdown. The plasma absorbs the energies of these pulses of laser beam and causes ignition without fail. In comparison with the ignition by only the first pulse of laser beam, the advantage of improved efficiency can be achieved, because the energy is continuously injected for a long period during the formation of the flame nucleus.

Since that the breakdown is caused by the first pulse of laser beam and that the produced plasma is irradiated by the second and third, . . . pulses of laser beam and absorbs their energies, the plasma is maintained to exist for a long time and hence ensures the ignition of the air-fuel mixture.

A pulse of laser beam with a high peak value can not be efficiently generated. As compared with the case in which a single pulse of laser beam is used for the ignition, irradiation of plurality of pulses of laser beam according to this invention is more efficient.

The energy of each pulse of laser beam needs not be larger than that of a single pulse of laser beam for the ignition. Therefore, this invention is more advantageous in view of the safety and the durability of a laser oscillator. A cost reduction can be also attained.

DESCRIPTION OF THE PREFERRED EMBODIMENTS

Figure 1:
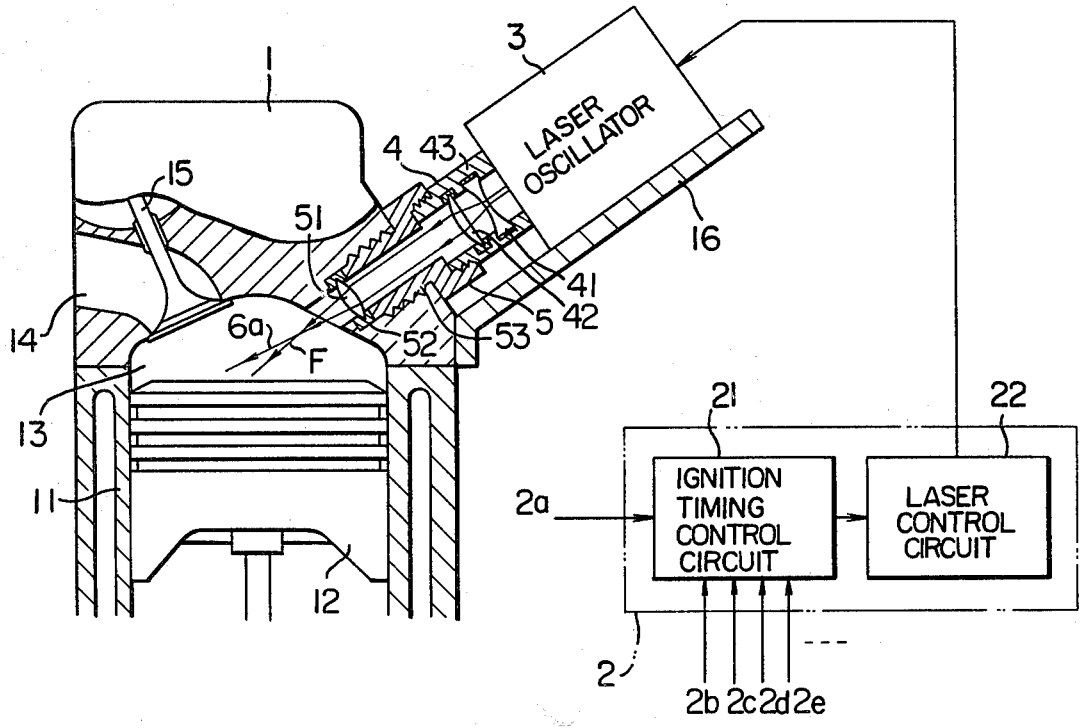
FIG. 1 is a general construction diagram containing a partial cross-section according to one embodiment of this invention.

The invention will be explained hereinafter with reference to the embodiments shown in the figures. FIG. 1 shows one embodiment of this invention in which a crosssection of one cylinder of a multi-cylinder internal combustion engine is illustrated. A reference numeral 1 denotes an internal combustion engine, 11 a cylinder, 12 a piston, 13 a combustion chamber, 14 an intake port, and 15 an intake valve. 16 denotes a support member for mounting thereon a laser device. 2 denotes an ignition control circuit including an ignition timing calculating circuit 21 which detects engine operating conditions and calculates the ignition timing, and includes a laser control circuit 22 which controls the laser oscillation in synchronism with the ignition timing. 3 is a laser oscillator which starts oscillation by a signal from the ignition control circuit 2. 4 is a beam expander which expands the beam diameter of the output of the laser oscillator 3 to form a parallel beam, and is comprised of a convex lens 41, a concave lens 42 and a holder 43. 5 is a light guide which guides the laser beam of light 6*a* enlarged by the beam expander into the combustion chamber 13 and focusses the beam. This light guide 5 includes a condenser lens 51, a packing 52 for fixing the lens 51 and separating the combustion chamber 13 from its exterior, and a holder 53.

Figure 2:
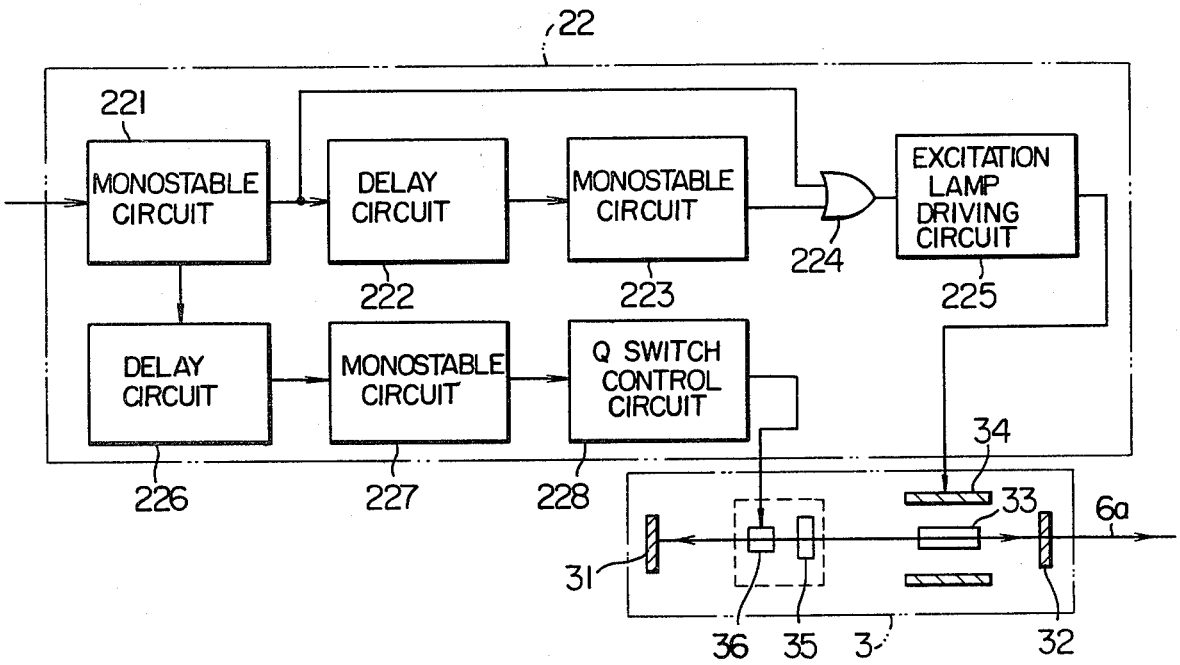
FIG. 2 is a detailed block diagram of a laser control circuit and a laser oscillator of FIG. 1.

FIG. 2 shows the deails of the laser oscillator 3 and the laser control circuit 22 which are the main parts of this invention. In this laser control circuit 22 of FIG. 2, 221 is a monostable circuit which receives a signal from the ignition timing control circuit 21 as an input and produces a pulse with a constant time width that rises with a rise of this input signal. 222 is a delay circuit which receives a signal from the monostable circuit 221 as an input and generates a pulse that rises at a time point delayed from the fall of this input by a constant time. 223 is a monostable circuit which receives a signal from the delay circuit 222 as an input and forms a pulse with a constant time width that rises with a rise of this input signal. 224 is an OR circuit whose inputs are the signals from the monostable circuits 221 and 223. 225 is an excitation lamp driving circuit which receives an output signal of the OR circuit 224 as an input, generates a high voltage when this input signal is at a "1" level and thereby drives an excitation lamp 34 of the laser oscillator 3. 226 is a delay circuit which receives a signal from the monostable circuit 221 as an input and produces an output signal which rises at a time point delayed from the rise of this input signal by a constant time. 227 is a publicly known monostable circuit which receives a signal from the monostable circuit 226 as an input and forms a pulse with a constant time width that rises with a rise of the input signal. 228 is a Q switch control circuit which receives a signal from the monostable circuit 227 as an input and generates a high voltage when the input signal is at the "0" level while interrupts the high voltage when it is at the "1" level, thereby controlling a Q switch of the laser oscillator 3. In the laser oscillator 3 of FIG. 2, 31 and 32 are reflecting mirrors, 33 is a solid crystal as a medium for the laser oscillation, 34 is a lamp for excitation, 35 is a polarization plate, and 36 is a Pockels cell. The Q switch is constituted with the polarization plate 35 and the Pockels cell 36. When a high voltage is applied from the Q switch control circuit 228 to the Pockels cell 36, light that has passed through the polarization plate 35 is linearly polarized and the light which is polarized by passing through the Pockels cell 36 and thereafter reflected by the reflecting mirror 31 is polarized twice. If we assume that the polarization angle is 45°, the light entering the polarization plate 35 again is polarized by 90°, and hence interrupted by the polarization plate 35. When no high voltage is applied to the Pockels cell 36 no polarization occurs at the Pockels cell 36. Therefore, the light that has passed through the polarization plate 35 is reflected by the reflecting mirror 31 and then passes through the polarization plate 35 again, and this enables the laser oscillation.

Figure 3:
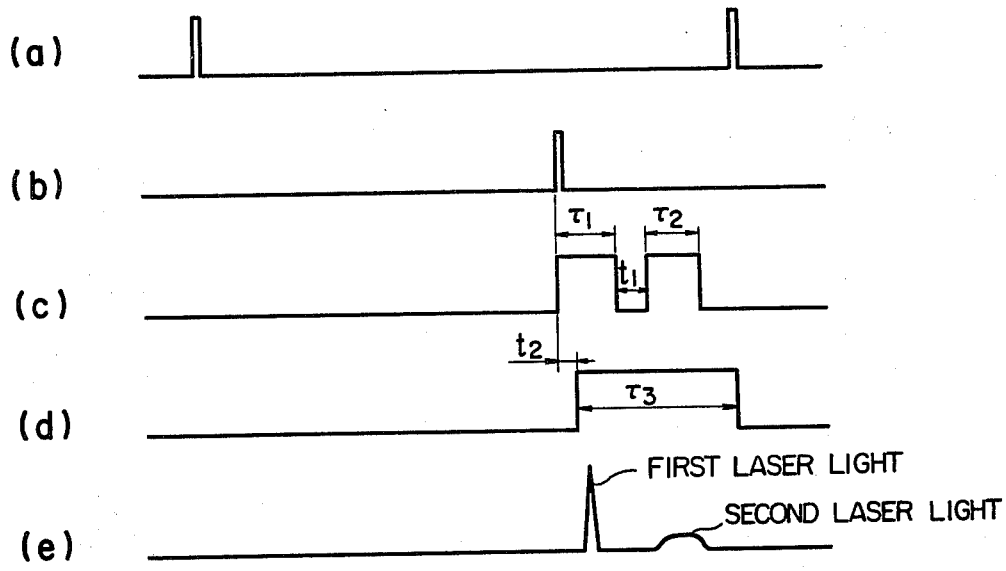
FIGS. 3A–3E show time charts for the explanation of the operation of the apparatus shown in FIG. 1.
Figure 4A:
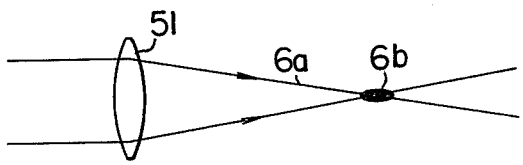
FIGS. 4A and 4B show diagrams for the explanation of the operation of the apparatus shown in FIG. 1.

The operation of the ignition apparatus of this invention with the above-mentioned construction will be explained with reference to the time charts of FIG. 3 and the explanatory view of FIG. 4. The ignition timing calculating circuit 21 receives a prescribed angle position signal (denoted by the arrow 2*a* of FIG. 1) of a crank shaft of the engine from a rotation angle detector (not shown) and determines an optimum ignition timing from the signals indicating the operating condition of the engine, e.g. rpm of engine, intake manihold pressure, cooling water temperature and acceleration or deceleration state (as denoted by the arrows 2*b*, 2*c*, 2*d*, 2*e* . . . ). In FIG. 3, (*a*) denotes a signal at the top dead center while (b) denotes an output signal of the ignition timing calculating circuit 21. The signal of (b) in FIG. 3 is introduced into the monostable circuit 221 of FIG. 2, which generates a pulse with a time width of $\tau_1$. The monostable circuit 223 generates a pulse with a time width of $\tau_2$ with a time delay of $t_1$ by the delay circuit 222. The output of the OR circuit 224, as shown in (c) in FIG. 3, includes two pulses starting from a time point of the ignition timing signal [FIG. 3 in (*b*)]. By means of the delay circuit 226, the monostable circuit 227 generates a pulse as shown in (d) in FIG. 3, with a time width of $\tau_3$ at a time point delayed by a time $t_2$ from the rise of the signal of (c) in FIG. 3. The signal of (c) in FIG. 3 is introduced into the excitation lamp driving circuit 225. When the signal (c) is at the "1" level, the excitation lamp 34 for the laser oscillator 3 is turned on. On the other hand, the signal (d) in FIG. 3 is introduced into the Q switch control circuit 228. When the signal (d) is at the "0" level, a high voltage is generated while it is made off when the signal is at the "1" level. With the signals of level "1" as shown in (c) in FIG. 3 from the excitation lamp driving circuit 225, the excitation lamp 34 is turned on. Simultaneously with a rise of the output signal of the ignition timing operation circuit 21, i.e., the signal of (b) in FIG. 3, the excitation lamp 34 is turned on. At this time, the Q switch control circuit 228 generates a high voltage so that the light entering the Pockels cell 36 is interrupted by the polarization plate 35, whereby the population inversion between the laser oscillation levels becomes extremely high. After the time $t_2$, since the high voltage of the Q switch control circuit 228 is cut off, the light can pass through the polarization plate 35. As a result the energy that has been stored in the laser oscillator 3 for a period of $t_2$ is released instaneously, and a laser beam with a high energy density is generated from the laser oscillator 3 toward the combustion chamber 13 of the engine. Next, a second signal [FIG. 3 in (*c*)] is supplied to the excitation lamp control circuit 225 and turns on the excitation lamp 34 again. At this time, since the Q switch is still operating, a laser beam with a lower energy density and a longer irradiation time than those of the first laser beam is generated from the laser oscillator 3 during the time when the excitation lamp 34 is on. The laser beam signals are shown schematically in (e) in FIG. 3. It is seen that a first laser light with a large peak power and a short duration is generated delayed by the time $t_2$ with respect to the signal from the ignition timing calculating circuit 21. Then, a second laser beam with a smaller peak power and a longer duration follows. The laser beam from the laser oscillator 3 is guided to the beam expander 4 and forms a parallel beam with a large beam diameter. After passing the light wave guide 5, it is focussed on a suitable ignition point in the combustion chamber 13 of the engine by the condenser lens 51. The beam diameter at the focus is made very small in order to increase the energy density. Thus, the first laser light can have an extremely high enengy density at the position of the focus enough to cause breakdown of the air-fuel mixture. The high temperature and high density plasma produced by the breakdown becomes a starter for firing the ambient air-fuel mixture.

Figure 4B:
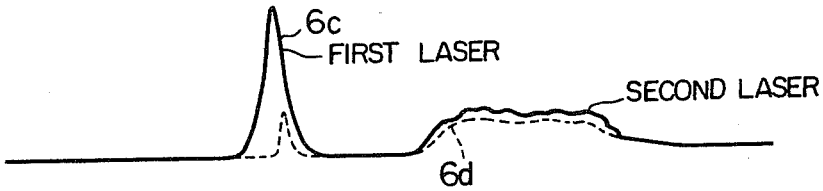

Meanwhile, it takes usually a few hundred μsec from the formation of the nucleus of flame to the development of flame. Since the plasma produced by the first laser light (cf. 6*b* of FIG. 4A) diffuses very rapidly to the periphery, it is difficult to obtain any perfect ignition by the first laser beam only. However, if the second laser beam is injected at a time shortly after the irradiation of the first laser beam, the plasma is irradiated once more by the second laser beam before it diffuses completely. Due to the absorption of the energy of the second laser beam, both the energy and the life time of the plasma increase, which ensures the perfect ignition of the air-fuel mixture. FIG. 4*b* shows the irradiated laser beams and the portions thereof absorbed by the plasma. The solid curve 6*c* shows the former while the dotted curve 6*d* shows the latter.

Figure 5:
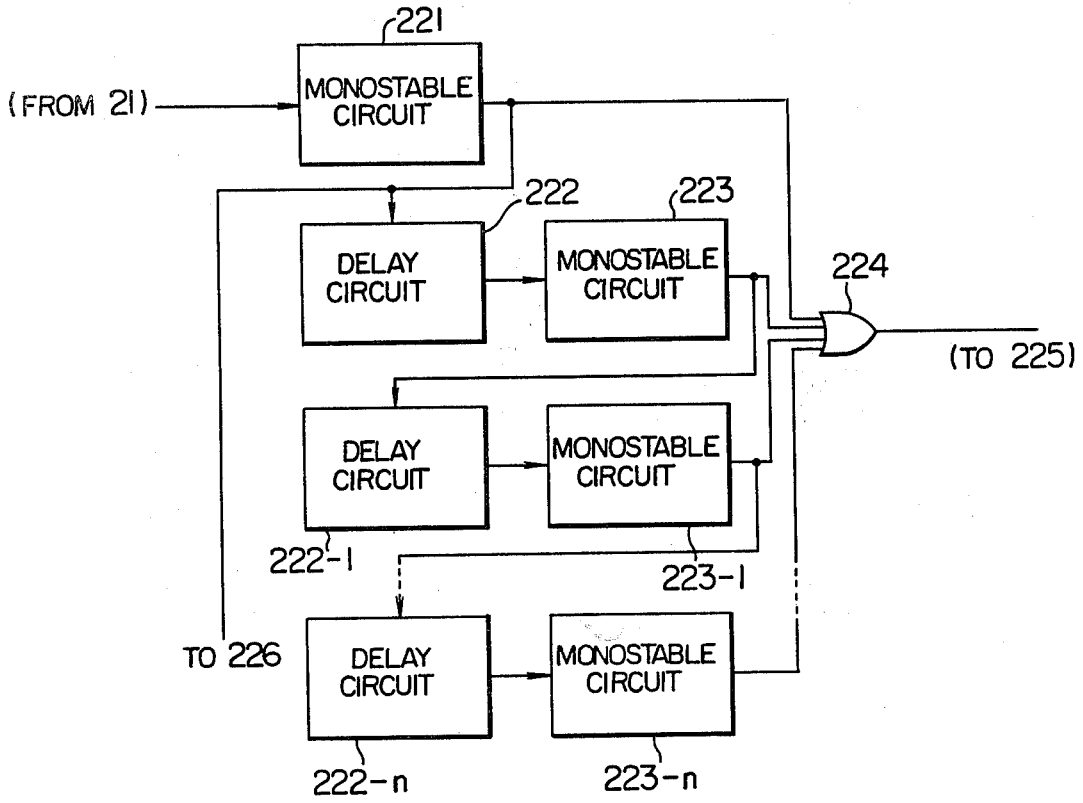
FIG. 5 is a detailed block diagram of a laser control circuit according to another embodiment of this invention.
Figure 6:
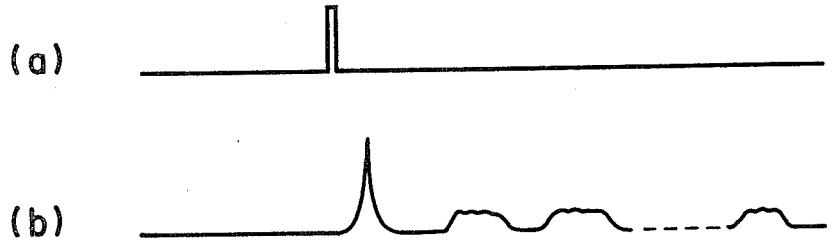
FIGS. 6A–6B show time charts for the explanation of the operation of the embodiment shown in FIG. 5.
Figure 7:
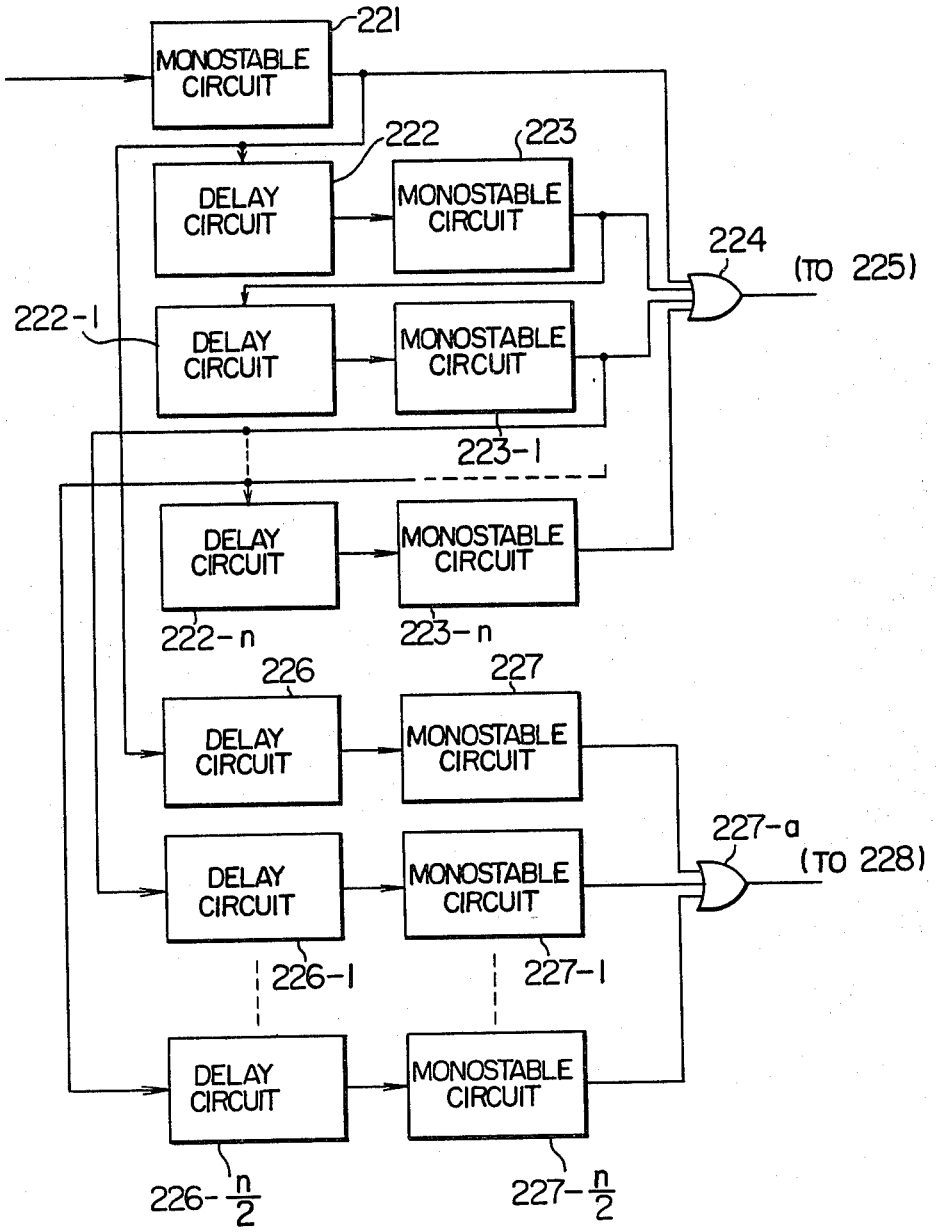
FIG. 7 is a detailed block diagram of a laser control circuit according to a further embodiment of this invention.

Although, in the above embodiment, two laser beams, the one having a large peak power and the other having a smaller peak power but a longer pulse duration, are irradiated, it is needless to say that more than two laser beams may be irradiated to make the ignition more reliable. FIGS. 5 and 7 show such embodiments. In FIG. 5, only those parts which differ from the foregoing embodiment are shown. A delay circuit 222-1 receives an output of the monostable circuit 223 as an input. A monostable circuit 223-1 receives a signal from the delay circuit 222-1 as an input. There are n pairs of delay circuits and monostable circuits. The final stage pair consists of a delay circuit 222-n and a monostable circuit 223-n. It is constituted such that all the outputs of the mounostable circuits 223-1 to 223-n are introduced into the OR circuit 224, which generates (n+2) pulses after the appearance of the ignition timing signal (a) of FIG. 6. The output of the laser oscillator 3 is shown in (b) in FIG. 6 in which the first laser beam has a large peak value while subsequent (n+1) laser beams have a smaller one. Therefore, according to this embodiment, the pulse-shaped laser beams are sequentially absorbed by a plasma produced by the breakdown by the first laser beam. Consequently, more reliable ignition is realized.

Figure 8:
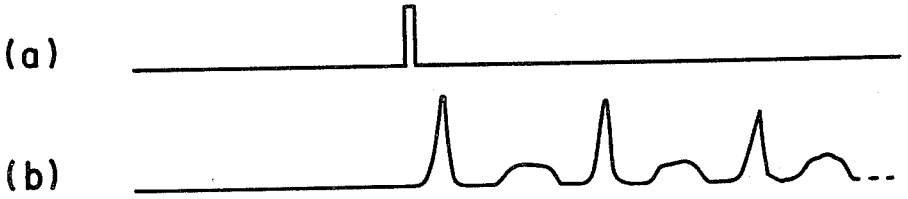
FIGS. 8A–8B show time charts for the explanation of the embodiment shown in FIG. 7.

A further embodiment is shown in FIG. 7. In this embodiment, delay circuits 222, 222-1, . . . 222-n and monostable circuits 221, 223, 223-1, . . . 223-n are the same as those in the embodiment shown in FIG. 5. Additional components are a delay circuit 226-1 which receives the output of the monostable circuit 223-1 as an input, a monostable circuit 227-1 which receives the output of the delay circuit 226-1 as an input, delay circuits 226-2, . . . 226-n/2 which receive the outputs of the alternate monostable circuit 223-3, . . . 223-(n-1) as inputs, monostable circuits 227-1, . . . 227-(n/2), and an OR circuit 227-a which receives the outputs of the monostable circuits 227, 227-1, . . . 227-(n/2) as inputs. In this case, the output of the OR circuit 227-a is given by the alternate output signals of the OR circuit 224. Therefore, the outputs of the laser oscillator 3 includes an alternate repetition of a laser beam with a large peak value and a laser beam with a smaller one, as shown in (b) in FIG. 8 with respect to an ignition timing signal [(a) in FIG. 8]. Even if it should happen that the plasma is quenched, another breakdown enables the ignition of the air-fuel mixture.

Although the embodiment shown in FIG. 7 repeats alternate generation of a laser beam with a large peak power and a laser beam with a smaller one, it may be possible that the former laser beam is generated at every two or three latter laser beams, or more irregularly.

Although, in the above embodiments, explanation has been made as to only one cylinder of a multicylinder internal combustion engine, this invention can also be realized in the following way. Namely, a similar laser oscillator may be fixed to each cylinder or, alternatively, one laser oscillator is used to distribute laser beams by using optical fibers, etc. to each cylinder in synchronization with the rotation of the engine.

Although in the above embodiment a solid state laser is used for the laser oscillator, any kind of laser may be used only if the Q switching is possible.

Although in the above embodiments a polarization plate and a Pockels cell using the Pockels are used for the Q switch, a Kerr cell or a Faraday cell may be used. A rotation prism and the ultrasonic wave are also applicable.

We claim:

1. A laser ignition apparatus for an internal combustion engine for igniting an air-fuel mixture supplied into a combustion chamber of said engine, comprising:

means for generating a laser beam of a high energy density;

means for controlling the generation of said laser beam in response to an ignition timing signal for said engine; and means for guiding and directing said laser beam from said laser beam generating means to a predetermined position within said combustion chamber, said laser beam generating means including a single laser oscillator for generating at least two pulse-shaped laser beams during each compression stroke of said engine, a first laser beam of said two pulse-shaped laser beams having a high energy density sufficient to cause breakdown of said air-fuel mixture, a second laser beam of said two pulse-shaped laser beams having an energy density lower than said first laser beam but having a longer duration, wherein said single laser oscillator includes means for controlling the production of said first laser beam of high energy density and said second laser beam of lower energy density and said first laser beam is effective to generate a plasma and said second laser beam is irradiated to the plasma before the plasma is diffused.

2. A laser ignition apparatus for an internal combustion engine for igniting an air-fuel mixture supplied into a combustion chamber of said engine, comprising:

means for generating a laser beam of a high energy density;

means for controlling the generation of said laser beam in response to an ignition timing signal for said engine; and means for guiding and directing said laser beam from said laser beam generating means to a predetermined position within said combustion chamber, said laser beam generating means generating at least two pulse-shaped laser beams during each compression stroke of said engine, a first laser beam of said two pulse-shaped laser beams having a high energy density sufficient to cause breakdown of said air-fuel mixture, a second laser beam of said two pulse-shaped laser beams having an energy density lower than said first laser beam but having a longer duration, said laser beam generating means including a Q switching element so that said first laser beam is generated by operating said Q switching element by a control signal from said controlling means and said second laser beam is generated without the operation of said Q switching element.

3. A laser ignition apparatus according to claim 2, wherein said means for generating laser beam generates more than two pulse-shaped laser beams and a first pulse-shaped laser beam is generated by the operation of said Q switching element and a second and other pulse-shaped laser beams following thereto are generated without the operation of said Q switching element.

4. A laser ignition apparatus according to claim 2, wherein said means for generating laser beam generates more than two pulse-shaped laser beams, and pulse-shaped laser beams having a high peak output and a lower peak output are alternately generated.

5. A laser ignition apparatus for setting fire by a laser beam a compressed air-fuel mixture in a combustion chamber of an internal combustion engine, said laser ignition apparatus comprising:

ignition timing calculating means for producing an ignition timing signal based on a crank angle position signal and signals representative of engine operating parameters;

laser control signal generating means connected to receive said ignition timing signal for generating an exciting lamp control signal and a Q switching control signal;

laser oscillator means connected to receive said exciting lamp control signal and said Q swtiching control signal, said laser oscillator means generating at least first and second successive pulse-shaped laser beams during the compression stroke of said engine, said first pulse-shaped laser beam having a short pulse width and a high peak output due to Q switching action caused by said Q switching control signal, and said second pulse-shaped laser beam having a wider pulse width and a lower peak output than said first pulse-shaped laser beam without the Q switching action by said Q switching control signal; and laser beam directing means attached to a cylinder head of said engine for guiding and condensing said at least first and second laser beams from said laser oscillator means into the combustion chamber of said engine, thereby to cause breakdown of the air-fuel mixture to produce plasma by said first pulse-shaped laser beam and to increase energy of plasma by said second pulse-shaped laser beam sufficient to ignite the air-fuel mixture.

* * * * *